US005894876A

United States Patent [19]

O'Brien

[11] Patent Number: 5,894,876

[45] **Date of Patent: *Apr. 20, 1999**

[54] WINDOW DRAPE WITH SELECTIVELY ADJUSTABLE APPEARANCE

[76] Inventor: Jane H. O'Brien, 4606 Edgefield Rd., Bethesda, Md. 20814

[ * ] Notice: This patent is subject to a terminal disclaimer.

[21] Appl. No.: 09/059,018

[22] Filed: Apr. 13, 1998

Related U.S. Application Data

[63] Continuation of application No. 08/768,240, Dec. 17, 1996, Pat. No. 5,738,159.

[51] Int. Cl.[6] ..... A47H 5/00

[52] U.S. Cl. ..... 160/84.01; 160/124; 160/348

[58] Field of Search ..... 160/84.01, 84.04, 160/123, 124, 237, 330, 348, 340, 341, 405, 126

[56] References Cited

U.S. PATENT DOCUMENTS

| | | | |
|---|---|---|---|
| 728,216 | 5/1903 | Essig . | |
| 1,578,858 | 3/1926 | Smythe . | |
| 2,167,651 | 8/1939 | Hess . | |
| 2,295,137 | 9/1942 | Sutton . | |
| 2,317,074 | 4/1943 | Mida | 160/124 |
| 2,528,652 | 11/1950 | Gundlach . | |
| 2,588,256 | 3/1952 | Lepow . | |
| 2,622,675 | 12/1952 | Jitomir . | |
| 2,627,918 | 2/1953 | Gordon . | |
| 2,671,508 | 3/1954 | Gordon . | |
| 2,840,155 | 6/1958 | Stern . | |
| 2,859,810 | 11/1958 | Sachs | 160/124 |
| 3,155,150 | 11/1964 | Silvestre . | |
| 3,160,202 | 12/1964 | Rosen . | |
| 3,388,734 | 6/1968 | Silvestre . | |
| 3,422,879 | 1/1969 | Ryan | 160/330 |
| 3,439,725 | 4/1969 | Haimovitz et al. . | |
| 3,734,809 | 5/1973 | Ellis . | |

(List continued on next page.)

FOREIGN PATENT DOCUMENTS 1507237 11/1966 France .

OTHER PUBLICATIONS

Esro price sheet, Jan.–Mar. 1996, one page.

Smith & Noble Windoware Catalog, 1995, p. 27.

*Primary Examiner*—David M. Purol

[57] ABSTRACT

A window drape includes a face panel and a liner having marginal portions secured to a back side of the face panel and an intramarginal portion carrying plural lengths of shirring tape oriented to extend vertically between top and bottom marginal portions of the liner and a plurality of guide elements arranged in a plurality of rows and columns. The face panel includes a pair of laterally opposed marginal portions folded against laterally opposed marginal portions of the liner and secured along respective vertically extending lines to define a pair of finished lateral edges for the drape, a lower marginal portion folded against the bottom marginal portion of the liner and secured along a laterally extending line to define a finished lower edge for the drape, and an upper marginal portion folded against the top marginal portion of the liner and secured along a pair of first and second laterally extending parallel lines to define an upper hem between a finished upper edge of the drape and the first line of securement and a rod pocket between the first line of securement and the second line of securement. The intramarginal portion of the liner is not secured to the face panel so that only marginal portions of the liner transmit lifting forces to the face panel thereby permitting arrangement of the window drape in a plurality of free-hanging and gathered styles without detracting from the overall appearance of the drape. Preferably, a plurality of loops and/or fasteners are affixed to a back side of the upper hem to define points of attachment for rings and/or tabs, respectively, without detracting from the look of the window drape when rings and tabs are not used.

9 Claims, 4 Drawing Sheets

U.S. PATENT DOCUMENTS

| | | | |
|---|---|---|---|
| 4,020,826 | 5/1977 | Mole | 160/330 X |
| 4,188,991 | 2/1980 | Boyle | 160/348 X |
| 4,765,388 | 8/1988 | Dohlemann . | |
| 4,877,075 | 10/1989 | Markowitz . | |
| 4,899,796 | 2/1990 | Easley et al. . | |
| 4,921,032 | 5/1990 | May . | |
| 4,976,301 | 12/1990 | Easley et al. . | |
| 5,191,922 | 3/1993 | Wade | 160/124 |
| 5,524,689 | 6/1996 | Clark | 160/124 |
| 5,738,159 | 4/1998 | O'Brien | 160/124 X |

WINDOW DRAPE WITH SELECTIVELY ADJUSTABLE APPEARANCE

This application is a continuation of patent application Ser. No. 08/768,240, filed Dec. 17, 1996, now U.S. Pat. No. 5,738,159, the disclosure of which is incorporated herein by reference.

BACKGROUND OF THE INVENTION

1. Field of the Invention

The present invention relates generally to window drapes and, more particularly, to a window drape capable of being selectively arranged in a number of styles.

2. Discussion of the Related Art

Window drapes are commonly used in homes to cover all or part of a window in a decorative manner. The drapes are typically supported on rods secured to the top of the window casing or to the wall adjacent the top of the window casing, with an upper portion of the window drape either being provided with rings or straps that encircle and slide upon the supporting rod, or with the upper portion of the window drape defining a loop or pocket through which the rod is passed before being attached to supporting brackets.

Most popular styles of window drape are commercially available in a variety of colors and fabrics, with standard widths and lengths to fit a wide range of window sizes. Thus, if a homeowner or decorator knows what type of style would look best for a particular application, they may purchase that style of drape, and any necessary supporting hardware, and thereafter install the window drape without much difficulty. If, however, the homeowner or decorator is unsure which style would look best, they must engage in a method of trial and error whereby they purchase a window drape of a first style, along with any necessary hardware, install the drape and then evaluate the appearance or suitability of the drape in the context of their decorating plans. If the style of drape is found to be unsuitable, the drape must be removed from the window, often with the hardware, and returned or discarded so that a window drape of a second style can be installed and evaluated. This process can be time consuming and frustrating, with repairs often being required to patch holes formed in the window casing or walls where supporting hardware was removed.

Even if the homeowner or decorator knows what style of window drape they desire at the time of purchase, it is not uncommon for a homeowner to grow tired of a particular look or for their taste to change thereby necessitating removal of the old window drape and installation of a new one. It is expensive and time consuming to continually purchase and discard window drapes, and many people are thus prevented from updating the look of their windows to achieve greater satisfaction and comfort in their homes.

SUMMARY OF THE INVENTION

Accordingly, it is a primary object of the present invention to overcome the disadvantages of prior art window drapes and to provide a window drape capable of being selectively arranged to achieve different styles.

Another object of the present invention is to facilitate redecoration of a window without the need of ha v ting to replace the original drape by allowing the drape to be rearranged into a different style.

A further object of the present invention is to provide a window drape which is selectively adjustable in appearance while being attractive, durable, relatively uncomplicated and inexpensive to manufacture, and easy to install.

Some of the advantages of the present invention are that restyling or adjustment of the window drape does not require special hardware, that features of the drape allowing the drape to be restyled are hidden from occupants of a room and are not visible after the drape has been installed, that the look or style of the drape can be changed without a lot of expense or effort, that the length or width of the drape can be made to accommodate any size window, that more than one drape can be mounted on a single rod to cover wider windows, and that the drape can be fabricated using any type of facing fabric or liner material in accordance with the desires of the consumer.

The present invention is generally characterized in a window drape including a face panel and a liner having marginal portions secured to a back side of the face panel and an intramarginal portion carrying plural lengths of shirring tape oriented to extend between top and bottom marginal portions of the liner and a plurality of guide elements arranged in a plurality of rows and columns. The face panel includes a pair of laterally opposed marginal portions folded against laterally opposed marginal portions of the liner and secured along respective vertically extending lines to define a pair of finished lateral edges for the drape, a lower marginal portion folded against the bottom marginal portion of the liner and secured along a laterally extending line to define a finished lower edge for the drape, and an upper marginal portion folded against the top marginal portion of the liner and secured along a pair of first and second laterally extending parallel lines to define an upper hem between a finished upper edge of the drape and the first line of securement and a rod pocket between the first line of securement and the second line of securement. In a preferred embodiment, the intramarginal portion of the liner is not secured to the face panel so that only marginal portions of the liner transmit lifting forces to the face panel thereby permitting arrangement of the window drape in a plurality of free-hanging and gathered styles without detracting from the overall appearance of the drape. A plurality of loops and/or fasteners are preferably affixed to a back side of the upper hem to define points of attachment for rings and/or tabs, respectively, without detracting from the look of the window drape when rings and tabs are not used.

Another aspect of the present invention is generally characterized in a method of fabricating a window drape including the steps of attaching plural lengths of shirring tape to a liner having marginal and intramarginal portions, attaching a plurality of guide elements to the intramarginal portion of the liner in multiple rows and columns, positioning the liner against a face panel such that the plural lengths of shirring tape and guide elements are disposed between the liner and the face panel, securing lateral and lower marginal portions of the liner and the face panel together to form laterally opposed and lower finished edges, inverting the liner and face panel such that the plural lengths of shirring tape and guide elements face outwardly from the lining, folding an upper marginal portion of the face panel against an upper marginal portion of the liner, and securing the upper marginal portion of the face panel along a pair of laterally extending parallel lines to form an upper hem between an upper finished edge and the first line of securement and a rod pocket between the first and second lines of securement. The intramarginal portion of the liner is left unsecured to permit arrangement of the window drape in a plurality of free-hanging and gathered styles without detracting from the overall appearance of the drape; and, preferably, a plurality of loops are secured to a back side of the upper hem to define points of attachment for a corresponding plurality of rings with an equal number of fasteners being affixed to a back side of the upper hem for attachment to matingly configured lower ends of a corresponding plurality of tabs having looped upper ends.

Other objects and advantages of the present invention will become apparent from the following description of the preferred embodiments taken with the accompanying drawings, wherein like parts in each of the several figures are identified by the same reference numerals.

DESCRIPTION OF THE PREFERRED EMBODIMENT

Figure 1:
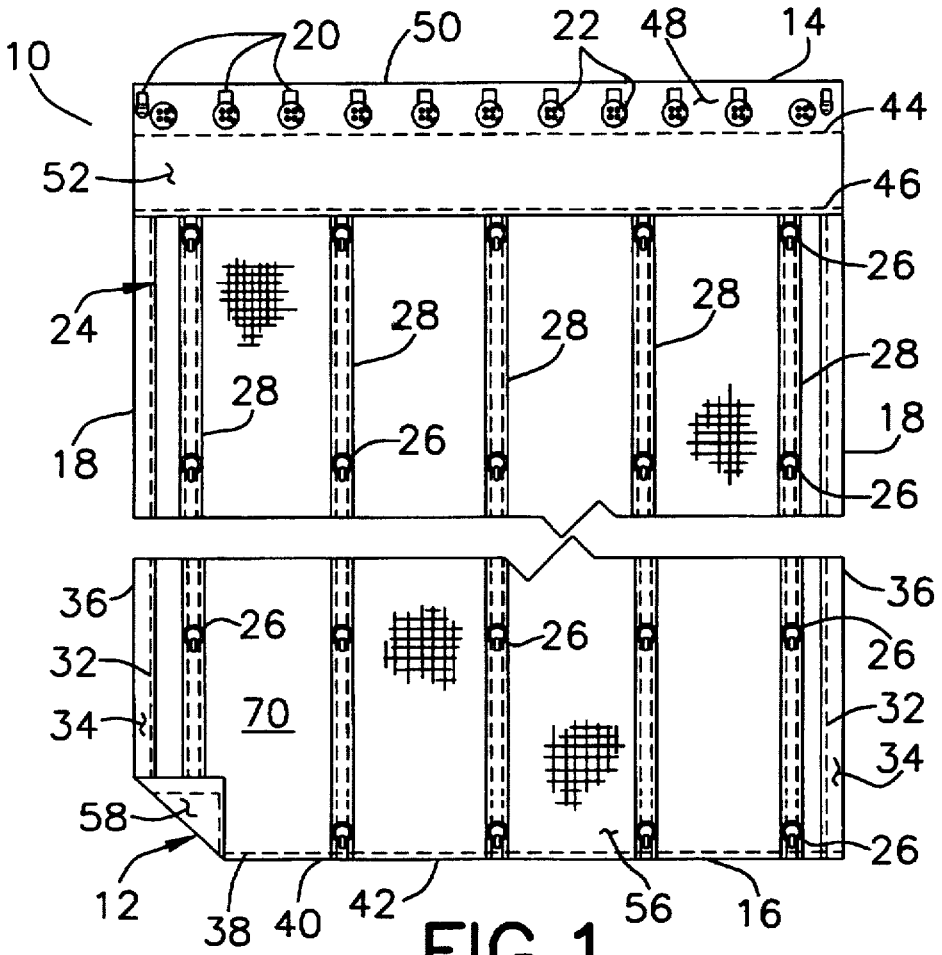
FIG. 1 is a back view, in plan, of a window drape in accordance with the present invention.
Figure 2:
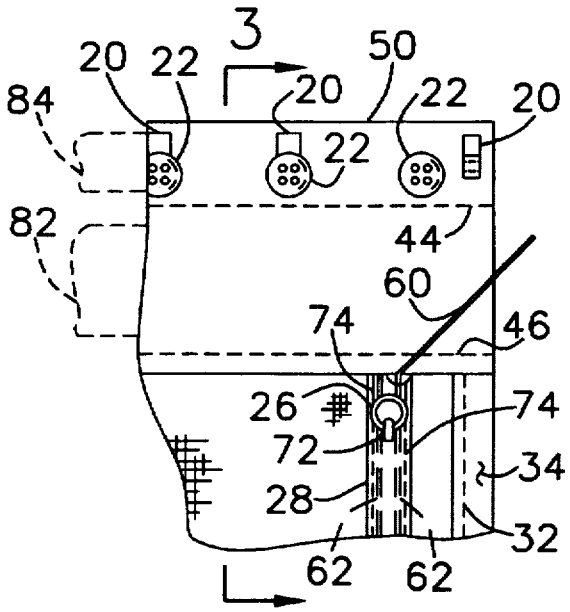
FIG. 2 is an enlarged fragmentary back view of an upper corner of the window drape shown in FIG. 1.
Figure 3:
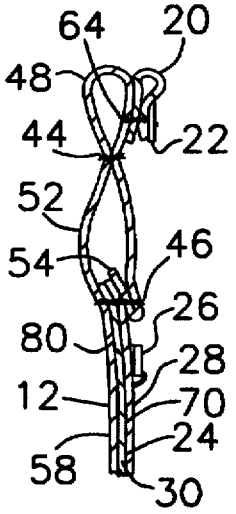
FIG. 3 is a side view, partly in section, taken through line 3—3 in FIG. 2.

A window drape 10 according to the present invention, as illustrated in FIGS. 1–3, includes a face panel 12 having upper, lower and lateral marginal portions 14, 16 and 18, a plurality of loops 20 extending upwardly from the upper marginal portion of the face panel at a respective plurality of laterally spaced locations, a corresponding plurality of button fasteners 22 secured to the upper marginal portion of the face panel adjacent the loops, and a liner 24 secured between marginal portions of the face panel and carrying a plurality of ring-like guide elements 26 mounted on plural lengths of shirring tape 28. Face panel 12 is of generally rectangular configuration and is preferably formed of a fabric, such as cotton or linen, or some other supple material. Lateral marginal portions 18 of the face panel are folded against a back or "wrong" side 30 of the face panel and secured with vertical lines of stitching 32 to form laterally opposed hems 34 between the finished lateral edges 36 and the lines of stitching. Lower marginal portion 16 of the face panel is folded upwardly against the back side of the face panel and is secured with a single laterally extending line of stitches 38 to define a lower hem 40 between the lower finished edge 42 of the drape and the line of stitches. Upper marginal portion 14 of the face panel is folded downwardly against the back side of the face panel and is secured with a pair of laterally extending parallel lines of stitches 44 and 46 to define an upper hem 48 between the upper finished edge 50 of the drape and the first line of stitches 44 and a rod pocket 52 between the first line of stitches and the second line of stitches 46. The vertical spacing between the upper finished edge and the first line of stitches is preferably chosen to define an upper hem having a height, for example 2.0 inches, to accept curtain rods or poles having vertical dimensions up to about 2.0 inches, while the vertical spacing between the first and second lines of stitching is preferably chosen to define a rod pocket having a height, for example 3.0 inches, to accept curtain rods or poles having vertical dimensions up to about 3.0 inches such as, for example, so-called continental curtain rods. The unfinished top edge 54 of the panel is folded upwardly to a position against the back side of the face panel and is held in place between the upper marginal portion and back side of the face panel by the second line of stitches 46.

Liner 24 is positioned against the back side of the face panel with marginal portions of the liner being secured between the folded marginal portions of the face panel and the back side of the face panel by lines of stitching 32, 38 and 46 extending through marginal portions of the face panel and the liner. The central or intramarginal portion 56 of the liner is not secured to the face panel, and a plurality of vertically extending parallel lengths of shirring tape 28 are secured to the intramarginal portion of the liner without being sewn directly to the face panel so as not to be visible when viewing the front or "right" side 58 of the face panel. Five parallel lengths of shirring tape 28 are shown extending vertically between upper and lower marginal portions 14 and 16 of the face panel at equal lateral intervals of about 12 inches; however, any number of lengths of tape can be secured to the liner at any angle relative to one another and with any regular or irregular lateral spacing therebetween. Each length of shirring tape 28 is preferably about 1.0 inch wide with at least one and preferably a pair of drawstrings or cords 60 disposed within vertical pockets or channels 62 defined by the tape and having lower ends secured to the lining adjacent the lower marginal portion of the face panel. Guide rings 26 have a diameter approximately equal to the width of shirring tape 28 and are secured to each length of shirring tape at a respective plurality of vertically spaced locations. Six rings 26 are shown affixed to each length of tape at intervals of about 9.75 inches between points of attachment; however, any suitable number of rings may be affixed to each length of tape using any regular or irregular vertical spacing.

Eleven loops 20 are shown affixed to the back side of upper hem 48 at laterally spaced locations across the width of the drape; however, any suitable number of loops can be used. Each loop 20 is preferably made of a strip or band of material, for example a two inch length of fabric ribbon, folded in half lengthwise and secured through its opposed end portions to the backside of the upper hem by stitches 64, or any other suitable fastening means, to provide points of attachment for a corresponding number of support rings. Loops 20 extend upwardly from stitches 64 to form an eyelet having an upper end preferably positioned below upper finished edge 50 of the window drape, for example about 0.375 inches below the finished edge, so that the loops and/or rings extending through the loops are hidden from observation when viewing the front side of the face panel. The loops are arranged symmetrically about a central loop aligned with a central longitudinal or vertical axis of the window drape; and, with the exception of the outermost loops immediately adjacent lateral edges of the window drape, the loops are preferably spaced at regular lateral intervals of about 5.0 inches center-to-center. The outermost loops are spaced at a slightly greater lateral interval, for example 5.25 inches center-to-center, to be disposed immediately adjacent the lateral edges of the window drape so that the drape hangs properly when supported by rings.

Figure 4:
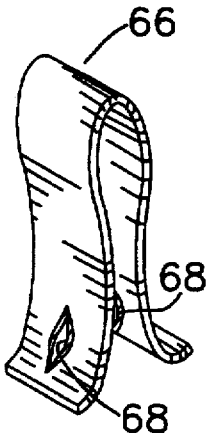
FIG. 4 is a perspective view of a tab for use with the window drape according to the present invention.

Button fasteners 22 are affixed to the back side of upper hem 48 at a plurality of laterally spaced locations along the width of the upper hem. Eleven button fasteners are shown arranged symmetrically about the central vertical axis of the drape at regular lateral intervals of about 5.0 inches center-to-center; however, any suitable number of button fasteners can be affixed to the drape at regular or irregular lateral intervals. It is preferred for the window drape to have an equal number of loops 20 and button fasteners 22 so that, with the exception of the outermost fasteners, which are laterally inset from the outermost loops, the fasteners can be sewn through respective end portions of each loop to reduce manufacturing time. The fasteners serve as a means for detachably affixing a corresponding number of tabs to the drape, with the spacing between fasteners being such that the lower portion of a tab affixed to an outermost fastener will not protrude beyond the finished lateral edge of the drape thereby concealing the mode of attachment. As best seen in FIG. 4, each tab 66 is preferably formed of a strip of material, for example matching the face panel fabric, having a pair of slits or button holes 68 formed along a longitudinal axis of the strip adjacent opposite axial ends of the strip. The tabs are preferably about 2.0 inches wide and about 10.5 inches long so that, when folded in half, opposite axial ends of each tab can be secured to one of the button fasteners with the folded edge of the tab protruding upwardly beyond the finished upper edge 50 to loop around a horizontal curtain rod or pole.

Figure 5:
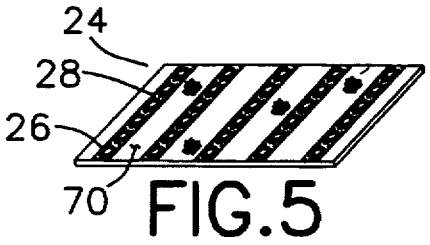
FIGS. 5–11 are perspective views illustrating a method of fabricating a window drape according to the present invention.

A method of fabricating a window drape 10 in accordance with the present invention is illustrated in FIGS. 5–11. While the method steps are described herein as being performed in a particular order using specific dimensions, it will be appreciated that the order in which the steps are performed as well as the dimensions can be varied in accordance with manufacturing considerations and individual preferences. Referring now to FIG. 5, liner 24 is, either supplied in its final size or cut from a larger sheet of material, for example to a final width of about 51.75 inches and a final length of about 57 inches, after which lengths of shirring tape 28 are arranged in parallel columns on the outward facing or "right" side 70 of the liner, for example about 12.0 to about 12.5 inches apart center-to-center, with respective outer edges of the outermost lengths of tape being spaced sufficiently, for example about 1.0 inch, from respective lateral edges of the liner to define lateral marginal portions or salvage for seam allowance. In the case of the shirring tape being of the so-called Austrian type, guide rings 26 may already be affixed to the shirring tape; otherwise, the rings can be affixed to the tape with stitching 72 before or after the tape has been secured to the liner. In either case, it is preferred that the lowermost or bottom ring be spaced sufficiently above the bottom edge of the liner, for example about 2.25 inches, to define a lower marginal portion for seam allowance. Once positioned, the lengths of tape 28 are pinned flat to the lining and secured thereto with vertically extending parallel lines of stitches 74 as shown, for example, in FIG. 2.

Figure 6:
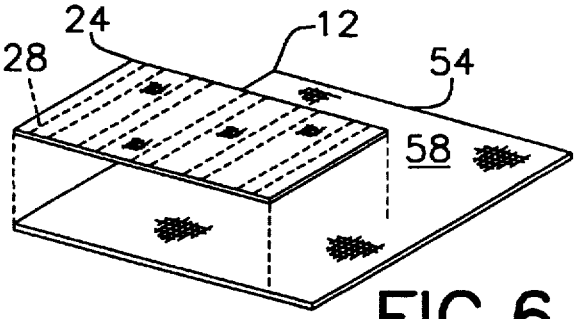
Figure 7:
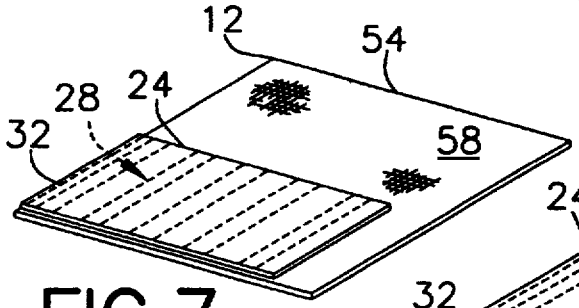
Figure 8:
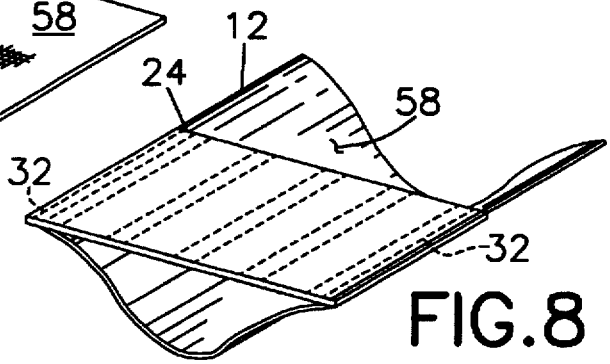
Figure 9:
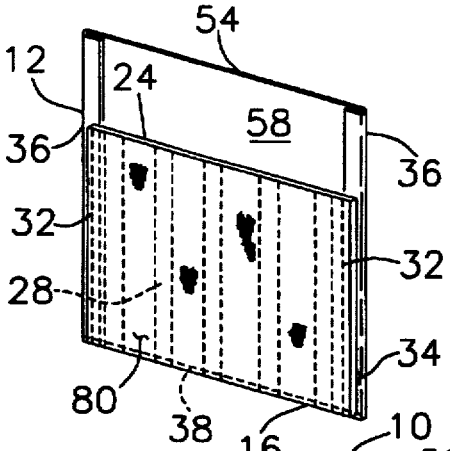

Referring to FIG. 6, face panel 12 is either supplied to size or cut from a larger sheet of material, for example to a final width of about 54.0 inches and a final length of about 65.0 inches, after which the "right" side 58 of the face panel is positioned against the "right" side 70 of the liner, with a lateral edge of the liner being aligned with a lateral edge of the face panel and respective bottom edges being aligned, as shown in FIG. 7. Aligned lateral edges are secured together with a single line of vertically extending stitches 32, after which the seam is pressed open and, as shown in FIG. 8, opposite lateral edges of the face panel and liner are aligned to be secured together with another line of vertically extending stitches 32, after which that seam is also pressed open. Face panel 12 is wider than liner 24 so that lateral edges of the face panel can be folded over against the "right" side of the face panel and pressed to form finished lateral edges 36 as shown in FIG. 9. Bottom edges of the face panel and the liner are then secured together along a single laterally extending line of stitches 38 to form the lower marginal portion 16 of the drape.

Figure 10:
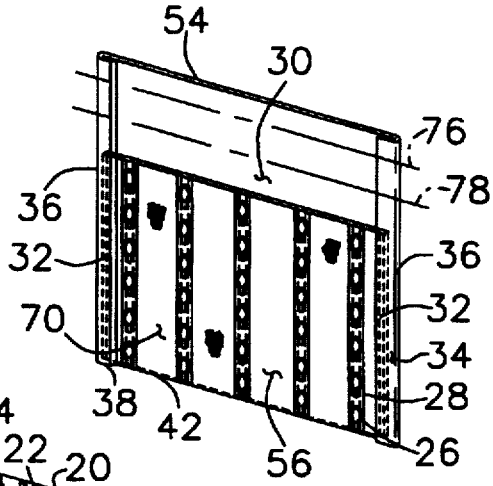
Figure 11:
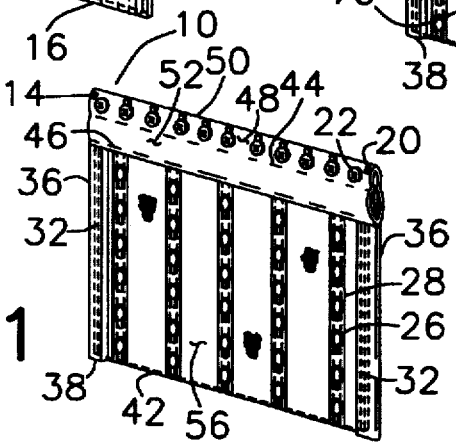

Referring now to FIG. 10, the face panel and liner are turned inside-out or inverted so that "wrong" sides 30 and 80 of the face panel and liner, respectively, face one another and "right" sides 58 and 70 of the face panel and liner, respectively, face outwardly together with the shirring tape 28 and guide rings 26. Top edge 54 of the face panel is folded downwardly against the "wrong" side 30 of the face panel along fold line 76 and then folded downwardly again against the "wrong" side of the face panel along fold line 78 to define the upper marginal portion 14. Fold line 76 is preferably located about 1.5 inches from the top edge whereas the location of fold line 78 is determined by measuring upward from the finished bottom edge 42 to the desired location of the upper finished edge 50 thereby establishing the ungathered length of the drape. Loops 20 and button fasteners 22 are secured to the upper marginal portion of the face panel adjacent finished upper edge 50, as shown in FIG. 11, with the folded top portions of the face panel being secured by lines of stitching 44 and 46 as described previously above.

Figure 12:
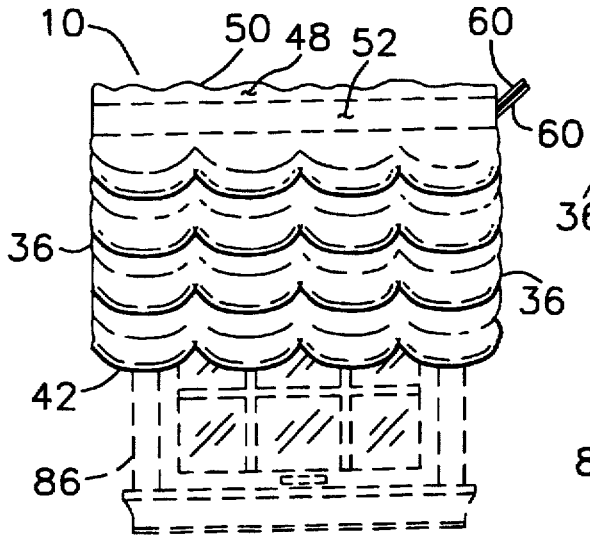
FIG. 12 is a front view, in plan, of the window drape arranged to resemble an Austrian drape.

In accordance with the present invention, window drape 10 can be installed and operated in a number of different ways to obtain a variety of different drapery styles. For example, the window drape can be installed to resemble an Austrian style drape as shown in FIG. 12 by inserting a conventional curtain rod 82 or 84 through rod pocket 52 or upper hem 48, respectively, and attaching the rod to supporting structure (not shown) mounted at the top of the window casing 86 in one of a number of conventional ways. Operation of the drape then involves elevating the lower edge of the liner, for example by simultaneously pulling several of the drawstrings 60 extending from shirring tape 28 in a generally upward direction, looking at FIG. 2, to exert a lifting force along the length of the intramarginal portion of liner 24 thereby elevating the lower edge of the liner. Marginal portions of liner 24 are secured to face panel 12 so that, as the intramarginal portion of the liner is elevated, the marginal portions will transmit a lifting force to the face panel, causing the face panel to be gathered upwardly and softly pleated along substantially all of its length as shown in FIG. 12. When a desired elevation is achieved, drawstrings 60 may be tied off in one of many conventional ways to maintain the desired appearance and style of the drape.

Figure 14:
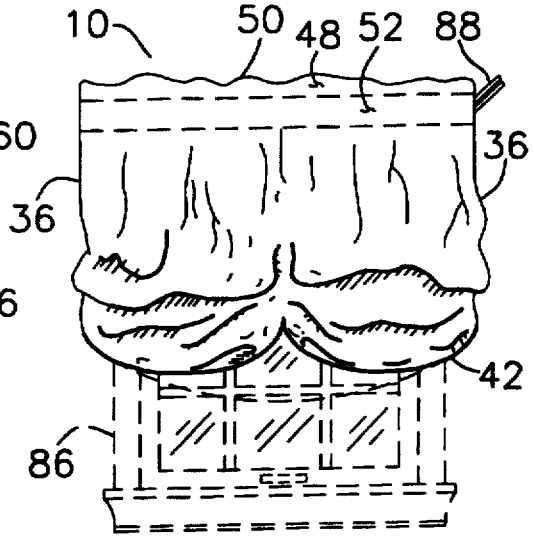
FIG. 14 is a front view, in plan, of the window drape arranged as shown in FIG. 13.
Figure 13:
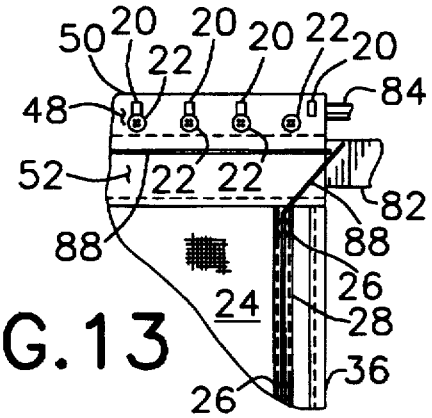
FIG. 13 is an enlarged fragmentary back view of an upper corner of the window drape arranged to create the appearance of a balloon drape.

Installation of the window drape 10 to resemble a balloon shade is illustrated in FIGS. 13 and 14 and is similar to the installation described above with the exception of using a number of drawstrings 88 threaded through guide rings 26 to elevate the drape. Each drawstring 88 is secured to the lowermost guide ring of a corresponding length of tape 28, for example by knotting the drawstring to the ring, and is threaded upwardly therefrom through the other guide rings and toward a common lateral edge 36 of the drape. Operation of the drape like a balloon shade involves pulling any combination of the several drawstrings 88 upwardly to exert a lifting force on only the lowermost rings of the tape, thereby elevating a lower end of the intramarginal portion of the liner which, in turn, causes a lower end of the face panel to be gathered upwardly into a gently scalloped, billowing shape as shown in FIG. 14. The number of scalloped portions is dependent upon the number and position of the drawstrings drawn upwardly, with the solid lines in FIG. 14 being the result of pulling on the outermost and central drawstrings, and the broken lines being the result of pulling on only the outermost drawstrings.

Figure 17:
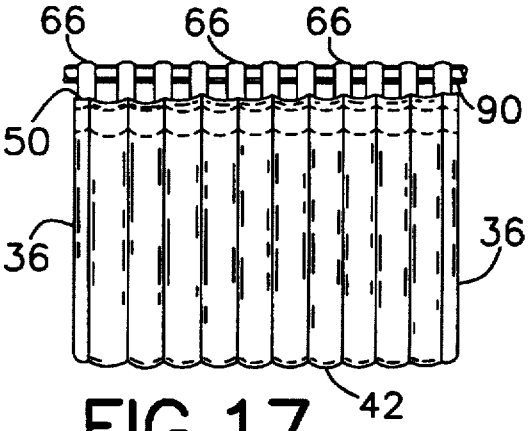
FIG. 17 is a front view, in plan, of the window drape arranged as shown in FIG. 15.
Figure 15:
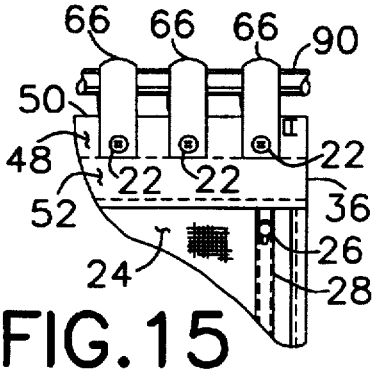
FIG. 15 is an enlarged fragmentary back view of an upper corner of the window drape arranged to create the appearance of a tab drape.
Figure 16:
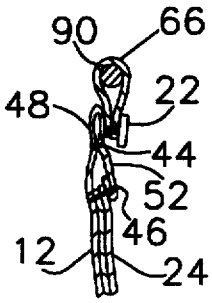
FIG. 16 is a side view, partly in section, of the tab drape arrangement of FIG. 15.

FIGS. 15–17 show an installation wherein the window drape 10 is suspended from a support member in the form of a pole 90 using plural tabs 66 attached to button fasteners 22 on the back of upper hem 48 so as to give the appearance of a tab drape. The tabs 66 are detachably affixed to the back of the upper hem by folding the tabs in half to align the button holes 68 and passing one of the button fasteners 22 through each pair of aligned button holes. The tabs 66 extend upwardly from the button fasteners and are looped around the curtain rod to support the window drape 10; however, since the button fasteners are secured only to the back of the upper hem, an observer cannot ascertain the detachable nature of the tabs. Similarly, because the intramarginal portion of the liner is not stitched to the face panel, there is no visual indication of the presence of shirring tape or guide rings when viewing the face panel from the front or "right" side, and the window drape therefore gives the appearance of being a genuine tab drape.

Figure 18:
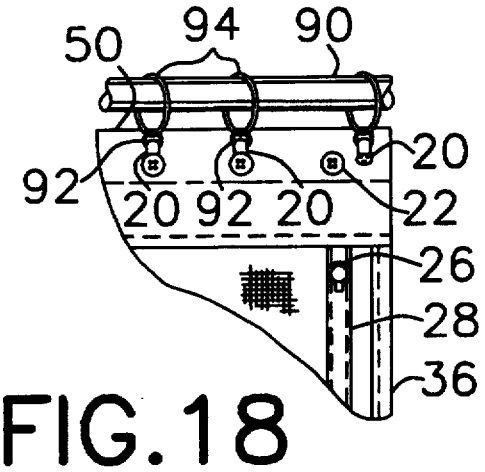
FIG. 18 is an enlarged fragmentary back view of an upper corner of the window drape arranged to create the appearance of a rod and ring drape.
Figure 19:
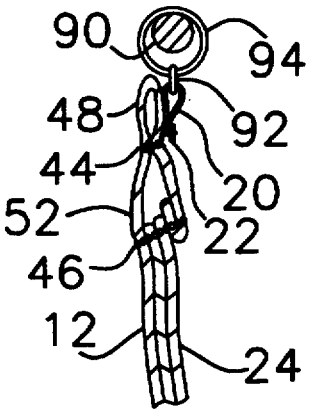
FIG. 19 is a side view, partly in section, of the rod and ring arrangement of FIG. 18.
Figure 20:
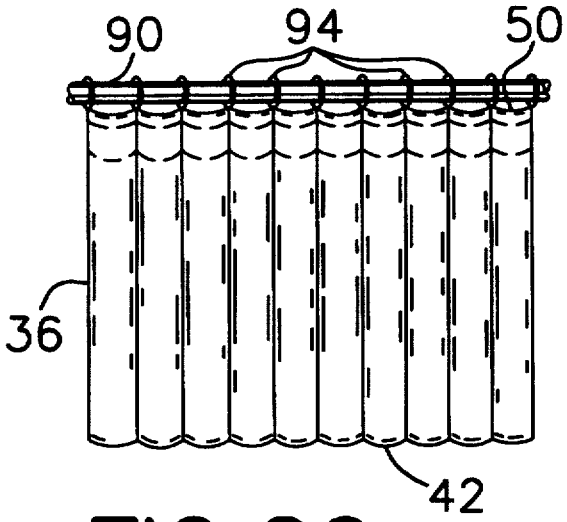
FIG. 20 is a front view, in plan, of the window drape arranged as shown in FIG. 18.

FIGS. 18–20 show another installation wherein the window drape 10 is suspended from a support member in the form of a pole 90; however, instead of tabs 66, the drape is hung from rings 92 and 94 attached to loops 20 on the back of upper hem 48 so as to give the appearance of a rod and ring drape. Each of the smaller rings 92 is generally circular in configuration with a small gap formed therethrough having a width large enough to receive the edge of a loop 20 when the ring is moved sideways to couple or link with the loop and small enough to prevent the loop from slipping through the gap in response to upwardly directed forces acting on the ring. Rings 94 are also of generally circular configuration but are somewhat larger than rings 92 to receive curtain rods such as, for example, the pole 90 shown in FIGS. 18–20. The larger rings 94 are linked to the smaller rings 92 and extend upwardly therefrom to be disposed above upper finished edge 50 of the drape. Since the stitches securing the loops to the upper marginal portion of the face panel extend only through the back of the upper hem, an observer cannot ascertain the presence of the loops, much less the shirring tape or guide rings, when viewing the face panel from the front or "right" side, and the window drape therefore gives the appearance of being a genuine rod and ring drape.

The window drape 10 can also be installed to hang freely from a rod or pole inserted through at least one of the upper hem 48 and rod pocket 52 as shown, for example, by broken lines in FIG. 2.

From the above, it will be appreciated that the window drape according to the present invention facilitates redecoration of a window without the need of having to replace or structurally modify the original drape by allowing the drape to be rearranged into different styles.

Components of the window drape such as the face panel and the liner can be made of any suitable materials including, but not limited to, cotton and linen fabrics. The face panel and liner can be made of the same material or of different materials, and it will be appreciated that the face panel can be provided in a variety of solid colors or with printed or embroidered patterns to match a wide range of decors.

The upper marginal portion of the window drape, including the upper hem and rod pocket, can be formed as an integral part of the face panel by stitching a folded edge of the face panel against itself as shown or by attaching a separate marginal panel to the face panel. Any number of fasteners and/or loops can be secured to the upper marginal portion of the window drape along the back side of the upper hem and/or the rod pocket to provide points of attachment for accessories such as tabs and rings. Although button fasteners are shown for attaching tabs to the upper marginal portion of the drape, it will be appreciated that any type of fastener can be used including, but not limited to, snaps, clips, buckles and mating strips of hook and loop fasteners. It will also be appreciated that the tabs can be formed with opposite ends unattached to one another and carrying cooperative fastening portions, such as button holes, or with one axial end affixed to a surface of the tab to form a loop and one cooperative fastening portion mounted on the tab above or below the point of attachment.

It is preferred that only marginal portions of the liner be secured directly to the face panel; however, dependent upon the texture or print of the face fabric and the desires of the user, intramarginal portions of the liner may be secured directly to the face panel. Moreover, while a number of installation options are shown to illustrate some of the styles that can be obtained with the window drape according to the present invention, it will be appreciated that the window drape can be installed in other ways to give the appearance of a multiplicity of other styles. Some of the styles shown and described herein may also be combined to create new styles heretofore unable to be formed.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A window drape comprising a face panel having front and back sides;

a liner having marginal and intramarginal portions positioned against said back side of said face panel;

said face panel having a pair of laterally opposed marginal portions positioned against laterally opposed marginal portions of said liner and secured along respective vertically extending lines to define a pair of finished lateral edges for the drape, a lower marginal portion positioned against said bottom marginal portion of said liner and secured along a laterally extending line to define a finished lower edge for the drape, and an upper marginal portion positioned at least partly against a top marginal portion of said liner and secured along at least a first laterally extending line to define a finished upper edge of said drape and a rod pocket between said finished upper edge of said drape and said first line of securement; and means secured to a back side of said drape between said finished upper edge of said drape and said first line of securement for detachably connecting at least one of a plurality of rings and a plurality of looped tabs to said window drape at a plurality of laterally spaced locations along a width of said upper marginal portion without obstructing passage of a rod through said rod pocket to permit selective arrangement of said window drape in a plurality of styles without detracting from the overall appearance of the drape.

2. A window drape as recited in claim 1 wherein said connecting means includes a plurality of upwardly extending loops secured to said back side of said drape at a respective plurality of laterally spaced locations to define a respective plurality of ring attachments.

3. A window drape as recited in claim 2 wherein upper ends of said upwardly extending loops do not extend substantially above said finished upper edge of said drape.

4. A window drape as recited in claim 3 and further comprising a plurality of rings extending upwardly from said loops to engage a rod above said finished upper edge of said drape.

5. A window drape as recited in claim 1 wherein said connecting means includes a plurality of fasteners secured to a back side of said drape at a respective plurality of laterally spaced locations to mate detachably with lower ends of a corresponding plurality of looped tabs.

6. A window drape as recited in claim 6 and further comprising a plurality of looped tabs extending upwardly from said fasteners to engage a rod beyond said finished upper edge of said drape.

7. A window drape as recited in claim 1 wherein said connecting means includes a plurality of upwardly extending loops secured to a back side of said drape at a respective plurality of laterally spaced locations to define a respective plurality of ring attachments and a plurality of fasteners secured to a back side of said drape at a respective plurality of laterally spaced locations to mate detachably with lower ends of a corresponding plurality of looped tabs.

8. A window drape as recited in claim 7 wherein at least one of said fasteners is secured to one of said upwardly extending loops.

9. A window drape as recited in claim 1 wherein said upper marginal portion of said face panel is folded against a top marginal portion of said liner and secured along a pair of first and second laterally extending parallel lines to define an upper hem between a finished upper edge of the drape and said second line of securement and a rod pocket between said first line of securement and said second line of securement, and wherein said connecting means is secured to a back side of said upper marginal portion of said face panel.

* * * * *